US007628142B2

(12) United States Patent
Hayman et al.

(10) Patent No.: US 7,628,142 B2
(45) Date of Patent: Dec. 8, 2009

(54) REMOTELY MOUNTED HIGH-PRESSURE FUEL PUMP ASSEMBLY

(75) Inventors: Alan W. Hayman, Romeo, MI (US); James J. Mazzola, III, Dryden, MI (US); David P. Sczomak, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 288 days.

(21) Appl. No.: 11/622,005

(22) Filed: Jan. 11, 2007

(65) Prior Publication Data

US 2008/0060605 A1 Mar. 13, 2008

Related U.S. Application Data

(60) Provisional application No. 60/824,961, filed on Sep. 8, 2006.

(51) Int. Cl.
*F02M 37/06* (2006.01)
*F02B 67/06* (2006.01)

(52) U.S. Cl. ..... 123/509; 123/198 C; 123/198 D

(58) Field of Classification Search ..... 123/495, 123/505, 507, 508, 509, 195 A, 198 C, 198 D; 417/313, 364

See application file for complete search history.

(56) References Cited

U.S. PATENT DOCUMENTS

| | | | | |
|---|---|---|---|---|
| 3,754,411 | A * | 8/1973 | Orain | 464/79 |
| 5,839,401 | A | 11/1998 | Gruber et al. | |
| 5,918,578 | A * | 7/1999 | Oda | 123/456 |
| 6,148,787 | A * | 11/2000 | Takano | 123/195 A |
| 6,244,239 | B1 | 6/2001 | Sisco et al. | |
| 6,302,086 | B1 | 10/2001 | Kato | |
| 2005/0016490 | A1 * | 1/2005 | Stone | 123/195 A |

FOREIGN PATENT DOCUMENTS

| | | | |
|---|---|---|---|
| DE | 4128432 | A1 | 3/1993 |
| DE | 10141887 | A1 | 4/2003 |
| DE | 102005029351 | A1 | 1/2006 |

* cited by examiner

*Primary Examiner*—Michael Cuff
*Assistant Examiner*—Ka Chun Leung

(57) ABSTRACT

An internal combustion engine is provided having an accessory drive system. A high-pressure fuel pump assembly is mounted with respect to the engine and driven by the accessory drive system. Additionally, the internal combustion engine includes an engine block and at least one cylinder head mounted thereto. The engine block and the at least one cylinder head delineate a plane. The high-pressure fuel pump assembly includes a high-pressure fuel pump that is mounted substantially behind the plane. The high-pressure fuel pump is driven by a drive shaft which is configured to collapse and/or telescope in the presence of an axial force of sufficient magnitude.

11 Claims, 3 Drawing Sheets

REMOTELY MOUNTED HIGH-PRESSURE FUEL PUMP ASSEMBLY

CROSS-REFERENCE TO RELATED APPLICATION

This application claims the benefit of U.S. Provisional Application No. 60/824,961, filed Sep. 8, 2006, which is hereby incorporated by reference in its entirety.

TECHNICAL FIELD

The present invention relates to a remotely mounted high-pressure fuel pump assembly for an internal combustion engine and more specifically for a high-pressure fuel pump assembly of a spark ignition direct injection engine.

BACKGROUND OF THE INVENTION

Fuel pumps for vehicles are used for pumping fuel from a fuel source to a fuel delivery system of an internal combustion engine. Depending on the type of fuel delivery system; carburetor, throttle body injection, port injection, or direct injection, the fuel is delivered under low- or high-pressure. A fuel injection system typically requires fuel to be delivered at higher pressure than that of a carburetor.

Traditional Spark Ignition Direct Injection (SIDI) engines employ a high-pressure fuel pump that is driven by a camshaft used for valve train actuation of the internal combustion engine. It is beneficial to drive the pump with the engine's camshaft or camshaft drive since the pump typically needs to be synchronized with engine timing.

For certain compact engine designs including, for example, engines having pushrod valve train systems, access to the camshaft and space for packaging the pump is limited. Therefore, to mount a high-pressure fuel pump directly operated by the engine camshaft would require a significant redesign of the engine block. Thus, in these situations, a remotely mounted, accessory-driven fuel pump would provide an alternative means to meet the requirements for such applications.

A remotely mounted, accessory-driven fuel pump may also be desirable in applications where modularity between the SIDI and multi-port fuel injection versions of the same engine is desired, or to reduce investment in engine changes to convert to SIDI. No commercially available engines, however, disclose an accessory driven high-pressure fuel pump.

SUMMARY OF THE INVENTION

An internal combustion engine, such as a spark-ignited direct injection engine, is provided having an accessory drive system. A high-pressure fuel pump assembly is mounted with respect to the engine and driven by the accessory drive system. Additionally, the internal combustion engine includes an engine block and at least one cylinder head mounted thereto. The engine block and at least one cylinder head delineate a plane. The high-pressure fuel pump assembly includes a high-pressure fuel pump, such as a rotary type or a piston type pump, that is mounted substantially behind the plane. The high-pressure fuel pump is driven by a drive shaft which is configured to collapse or telescope in the presence of an axial force of sufficient magnitude.

In one embodiment, the high-pressure fuel pump may be a piston type pump having a camshaft configured to operate the high-pressure fuel pump. The drive shaft may be configured to selectively telescope within the camshaft in the presence of an axial force of sufficient magnitude.

In another embodiment, the drive shaft of the high-pressure fuel pump assembly may include a tube portion and a shaft portion in engagement with the tube portion for unitary rotation therewith. The shaft portion may be configured to selectively telescope within the tube portion in the presence of an axial force of sufficient magnitude. Alternately, the drive shaft may include a plurality of pleats to allow the collapsing or bucking of the drive shaft in the presence of an axial force of sufficient magnitude.

In yet another embodiment, the drive shaft may include a pulley sufficiently configured to engage a drive belt of the accessory drive system. Furthermore, the high-pressure fuel pump assembly may include a sensor, such as a Hall Effect type sensor, operable to provide pump synchronization with the internal combustion engine.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
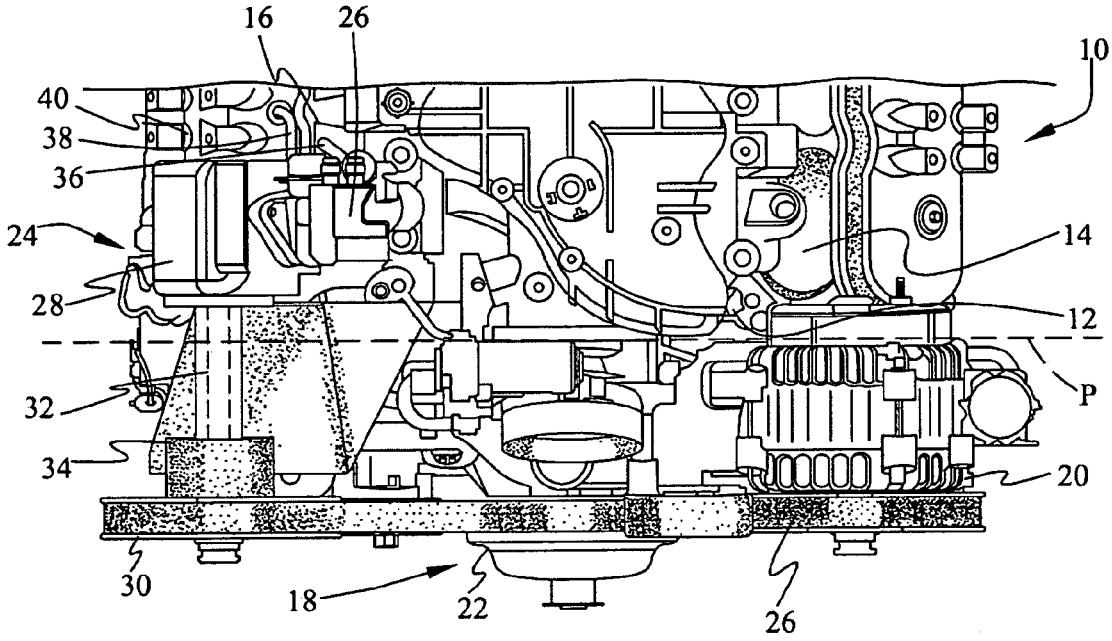
FIG. 1 is a top view of a portion of a spark ignited direct injection internal combustion engine incorporating a remotely mounted "piston type" high-pressure fuel pump assembly in accordance with the present invention.

Referring to the drawings, wherein like reference numbers correspond to like or similar components throughout the several figures, there is shown in FIG. 1 an internal combustion engine, generally indicated at 10. The internal combustion engine is preferably a Spark Ignition Direct Injection, or SIDI, engine the operation of which is known to those skilled in the art. The internal combustion engine 10 is shown as a V-type engine having cylinder bores, not shown, arranged in a V-shaped fashion. Those skilled in the art will recognize that the invention described hereinbelow may be applied to other engine types such as inline, horizontally opposed, W-type, etc.

The internal combustion engine 10 includes an engine block 12 having a first cylinder head 14 and a second cylinder head 16 mounted thereto. An accessory drive system 18 is mounted with respect to the internal combustion engine 10 ahead of a plane, indicated by broken line P (the plane being perpendicular to the page), which is delineated by the engine block 12 and the first and second cylinder heads 14 and 16, respectively. Therefore, the engine block 12 and the first and second cylinder heads 14 and 16 are disposed generally behind plane P, while the accessory drive system 18 is disposed substantially in front of plane P. The orientation of the plane P within the vehicle, not shown, will vary depending on the orientation of the internal combustion engine 10. For a longitudinal orientation of the internal combustion engine 10, the plane P will face toward the front of the vehicle. Alternately, for a transverse orientation of the internal combustion engine 10, the plane P will face toward either the driver's side or passenger's side of the vehicle.

The accessory drive system 18 includes an alternator 20, water pump 22, and a high-pressure fuel pump assembly 24 all of which are driven by a serpentine drive belt 25. The serpentine drive belt 25 transmits torque from the crankshaft, not shown, of the internal combustion engine 10 to the alternator 20, water pump 22, and high-pressure fuel pump assembly 24. Those skilled in the art will recognize that the accessory drive system 18 may include additional components, such as a power steering pump, air conditioning compressor, etc. while remaining within the scope of that which is claimed. Since the high-pressure fuel pump assembly 24 is not driven directly by the engine's camshaft, not shown, or cam drive, not shown, as in conventional fuel pump drives, the high-pressure fuel pump assembly 24 can be characterized as remotely mounted.

The high-pressure fuel pump assembly 24 includes a high-pressure fuel pump 26 mounted with respect to a pump camshaft housing 28. The high-pressure fuel pump assembly 24 further includes a pulley 30 operable to transfer driving torque from the serpentine drive belt 25 to a drive shaft 32, shown as a broken line. The drive shaft 32 is configured to drive the high-pressure fuel pump 26 in a manner to be described hereinbelow with reference to FIG. 2.

A bearing support bracket 34 and the pump camshaft housing 28 cooperate to mount the high-pressure fuel pump assembly 24 with respect to the internal combustion engine 10. The high-pressure fuel pump 26 is preferably mounted behind the plane P, thereby reducing the likelihood of damage caused to the high-pressure fuel pump 26 in the event of a vehicle accident or impact. A high-pressure oil feed 36 may be provided should the high-pressure fuel pump assembly 24 require an external lubrication source. The oil may drain from the high pressure fuel pump 26 to an area beneath a rocker cover 40. Alternately, an oil return passage 38 may be provided in a rocker cover 40 to enable drain back of lubricant from the high-pressure fuel pump assembly 24.

Figure 2:
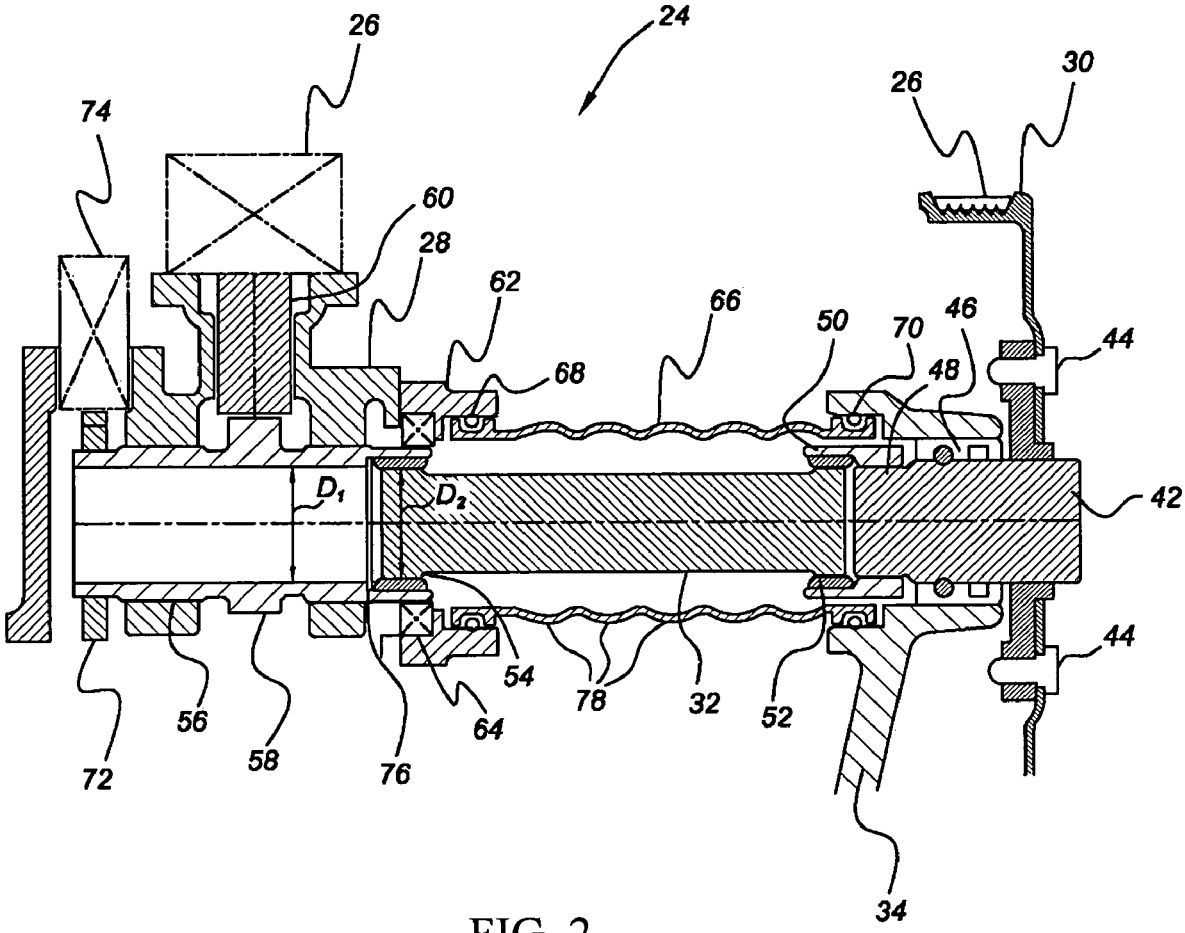
FIG. 2 is a schematic cross sectional illustration of the remotely mounted "piston type" high-pressure fuel pump assembly of FIG. 1.

Referring now to FIG. 2, there is shown a cross sectional view of the high-pressure fuel pump assembly 24. The pulley 30 is mounted to a flanged shaft 42 via a plurality of fasteners 44. The flanged shaft 42 is rotatably supported within the bearing support bracket 34 by a bearing 46. The bearing 46 may be a type known in the art such as a roller bearing, ball bearing, journal bearing, etc. The flanged shaft 42 includes an end portion 48 sufficiently configured to engage a coupling member 50 for unitary rotation therewith. The end portion 48 may engage the coupling member 50 through an interference fit, threaded engagement, or any other engagement mechanism known in the art to substantially limit the axial movement between the flanged shaft 42 and the coupling member 50, while allowing the transfer of torque therebetween.

The coupling member 50 is sufficiently configured to engage the drive shaft 32 for unitary rotation therewith. The coupling member 50 preferably engages a first end 52 of the drive shaft 32 via a splined engagement, hex engagement or any other engagement mechanism known in the art to allow the axial movement between the coupling member 50 and the drive shaft 32, while allowing the transfer of torque therebetween. A second end 54 of the drive shaft 32 is sufficiently configured to engage a camshaft 56 for unitary rotation therewith. The second end 54 of the drive shaft 32 preferably engages the camshaft 56 via a splined engagement, hex engagement or any other engagement mechanism known in the art to allow the axial movement between the drive shaft 32 and the camshaft 56, while allowing the transfer of torque therebetween. The camshaft 56 is rotatably supported within the pump camshaft housing 28 and includes an eccentric cam 58 operable to selectively bias a piston 60 to effect operation of the high-pressure fuel pump 26 with the rotation of the camshaft 56.

A seal support 62 is mounted to the pump camshaft housing 28 and is configured to retain a seal member 64 in relation to the camshaft 56 to reduce the likelihood external leakage of lubricant from within the pump camshaft housing 28. Additionally, the seal member 64 may prevent the intrusion of foreign matter into the pump camshaft housing 28, thereby increasing the reliability of the high-pressure fuel pump assembly 24. A sleeve 66 extends between the seal support 62 and the bearing support bracket 34 and is sealed by seal members 68 and 70, respectively. The sleeve 66 is operable to prevent infiltration of foreign matter, such as dirt, water, grease, etc. within the high-pressure fuel pump assembly 24.

A target wheel 72 is mounted with respect to the camshaft 56, while a sensor 74 is mounted with respect to the pump camshaft housing 28. The sensor 74 and the target wheel 72 cooperate to provide camshaft position information for pump synchronization purposes. The sensor may be any type known in the art, such as a Hall Effect sensor, while remaining within the scope of that which is claimed.

The camshaft 56 is preferably formed with a hollow center having an internal diameter of D1, while the drive shaft 32 is formed having an external diameter of D2. Preferably, the diameter D1 is greater than the diameter D2. A shaft retainer 76 is provided within the camshaft 56 and operates to maintain the relative axial position between the drive shaft 32 and the camshaft 56. Should an axial force of sufficient magnitude be applied to the pulley 30 and the flanged shaft 42, such as in a vehicle impact situation, the driveshaft 32 will cause the shaft retainer 76 to shear thereby allowing the translation of the drive shaft 32 within the camshaft 56. This relative translational or axial movement between the drive shaft 32 and the camshaft 56 allows a predetermined amount of deflection to occur within the high-pressure fuel pump assembly 24 while allowing the high-pressure fuel pump 26 to remain substantially undamaged. The sleeve 66 includes a plurality of pleats 78, which allow the sleeve 66 to collapse or buckle as the drive shaft 32 telescopes within the camshaft 56.

Figure 3:
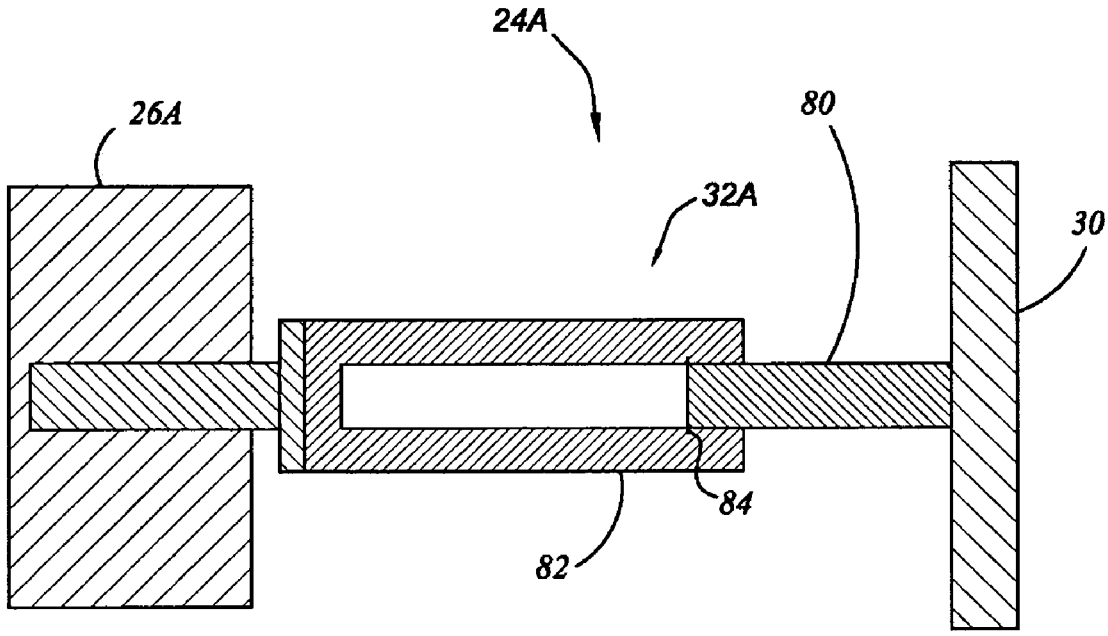
FIG. 3 is a schematic cross sectional illustration of a remotely mounted "rotary type" high-pressure fuel pump assembly in accordance with the present invention.

Referring now to FIG. 3, there is shown an alternate embodiment of the high-pressure fuel pump assembly 24 of FIGS. 1 and 2, generally indicated at 24A. The high-pressure fuel pump assembly 24A includes a high-pressure fuel pump 26A driven by the pulley 30 through a drive shaft 32A. The high-pressure fuel pump 26A is preferably a "rotary type" pump. The drive shaft 32A includes a shaft portion 80 disposed at least partially within a tube portion 82. The shaft portion 80 preferably engages the tube portion 82 via a splined engagement, hex engagement or any other engagement mechanism known in the art to allow axial movement between the shaft portion 80 and the tube portion 82, while allowing the transfer of torque therebetween. A shaft retainer 84 is provided within the tube portion 82 and operates to limit the axial movement of the shaft portion 80 within the tube portion 82. Should an axial force of sufficient magnitude be applied to the pulley 30, such as in a vehicle impact situation, the shaft portion 80 will cause the shaft retainer 84 to shear thereby allowing the translation of the shaft portion 80 within the tube portion 82. This relative translational or axial movement between the shaft portion 80 and the tube portion 82 allows a predetermined amount of deflection to occur within the drive shaft 32A while allowing the high-pressure fuel pump 26A to remain substantially undamaged.

Figure 4:
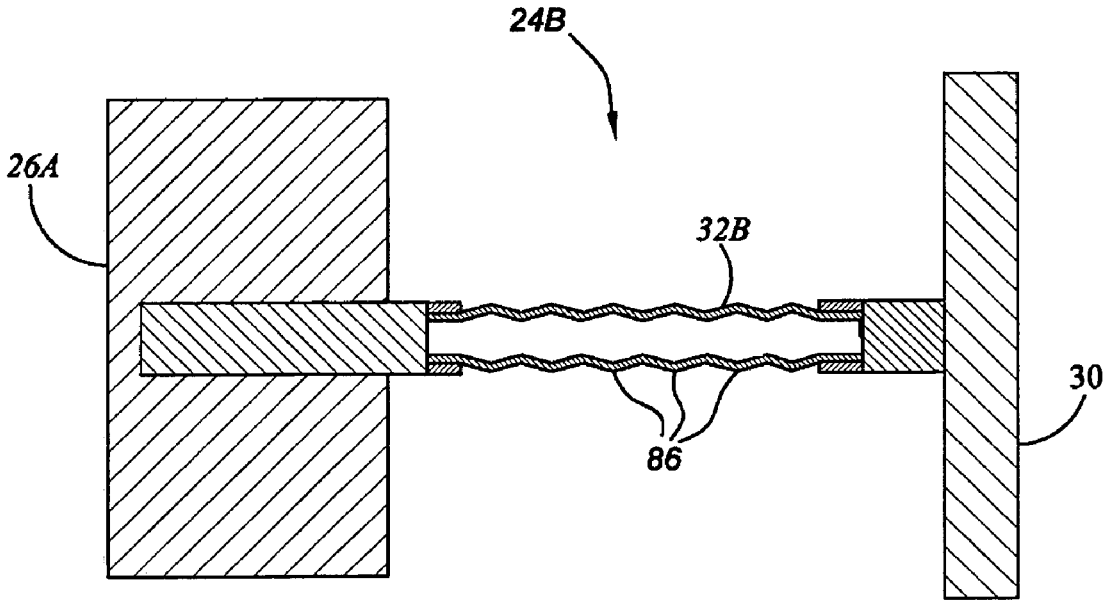
FIG. 4 is a schematic cross sectional illustration of an alternate embodiment of the remotely mounted "rotary type" high-pressure fuel pump assembly of FIG. 3.

Referring now to FIG. 4, there is shown an alternate embodiment of the high-pressure fuel pump assembly 24A of FIG. 3, generally indicated at 24B. The high-pressure fuel pump assembly 24B includes a high-pressure fuel pump 26A driven by the pulley 30 through a drive shaft 32B. As in FIG. 3, the high-pressure fuel pump 26A is preferably a "rotary type" pump. The drive shaft 32B is generally tubular in shape and includes a plurality of pleats 86. The tube is preferably designed to allow the effective transfer of torque between the pulley 30 and the high-pressure fuel pump 26A. Should an axial force of sufficient magnitude be applied to the pulley 30, such as in a vehicle impact situation, the pleats 86 will allow the drive shaft 32B to collapse or buckle, thereby allowing a predetermined amount of deflection to occur within the drive shaft 32B while allowing the high-pressure fuel pump 26A to remain substantially undamaged.

The telescoping nature of the drive shafts 32 and 32A and the bucking nature of the drive shaft 32B in conjunction with the positioning of the high-pressure fuel pumps 26 and 26A behind the plane P (i.e. toward the top of the drawing as viewed in FIG. 1), shown in FIG. 1, and delineated by the edge of the cylinder heads 14 and 16 and the engine block 12, is effective in isolating the high-pressure fuel pumps 26 and 26A from certain types of impact loads.

While the best modes for carrying out the invention have been described in detail, those familiar with the art to which this invention relates will recognize various alternative designs and embodiments for practicing the invention within the scope of the appended claims.

The invention claimed is:

1. An internal combustion engine comprising:

an accessory drive system;

a high-pressure fuel pump assembly mounted with respect to the engine and driven by said accessory drive system; and wherein said high-pressure fuel pump assembly includes:

a high-pressure fuel pump;

a drive shaft having a proximal end operatively engaged to said high-pressure fuel pump and a distal end operatively coupled to said accessory drive system; and wherein said drive shaft further includes:

a tube portion; and a shaft portion in engagement with said tube portion for unitary rotation therewith and configured to selectively telescope within said tube portion in the presence of an axial force of sufficient magnitude.

2. The internal combustion engine of claim 1, further comprising:

an engine block;

at least one cylinder head mounted to said engine block;

wherein said engine block and said at least one cylinder head delineate a plane;

wherein said engine block and at least one cylinder head are disposed substantially behind said plane and wherein said accessory drive system is disposed substantially in front of said plane;

wherein said high-pressure fuel pump assembly includes a high-pressure fuel pump; and wherein said high-pressure fuel pump is disposed substantially behind said plane.

3. The internal combustion engine of claim 1, wherein said high-pressure fuel pump is a rotary type fuel pump.

4. The internal combustion engine of claim 1, wherein said high-pressure fuel pump is a piston type fuel pump and said tube portion of said drive shaft is a camshaft configured to operate said high-pressure fuel pump;

wherein said shaft portion of said drive shaft is operable to drive said camshaft; and wherein said shaft portion of said drive shaft is configured to selectively telescope within said camshaft in the presence of an axial force of sufficient magnitude.

5. The internal combustion engine of claim 1, wherein the high-pressure fuel pump assembly includes:

a camshaft configured to operate said high-pressure fuel pump, wherein said drive shaft is operable to drive said camshaft;

a target wheel mounted with respect to said camshaft; and a sensor, wherein said sensor and said target wheel cooperate to provide position information for said camshaft, such that said sensor is operable to provide pump synchronization.

6. The internal combustion engine of claim 1, wherein the internal combustion engine is a spark ignited direct injection engine.

7. The internal combustion engine of claim 1, wherein said accessory drive system is driven by a drive belt.

8. An internal combustion engine comprising:

an accessory drive system;

a high-pressure fuel pump assembly mounted with respect to the engine and driven by said accessory drive system; and wherein said high-pressure fuel pump assembly includes:

a high-pressure fuel pump;

a drive shaft having a proximal end operatively engaged to said high-pressure fuel pump and a distal end operatively coupled to said accessory drive system, wherein said drive shaft is configured to allow said distal end to displace relative to said proximal end in the presence of a force of sufficient magnitude; and wherein said drive shaft includes a plurality of pleats and wherein said drive shaft is configured to selectively buckle in the presence of an axial force of sufficient magnitude.

9. A high-pressure fuel pump assembly for an internal combustion engine having a cylinder block, cylinder head, and an accessory drive system, the high-pressure fuel pump assembly comprising:

a high-pressure fuel pump mounted with respect to the internal combustion engine, wherein a plane is delineated by at least one of the cylinder block and cylinder head such that at least one of the cylinder block and cylinder head is disposed substantially behind said plane and the accessory drive system is disposed substantially in front of said plane and said high-pressure fuel pump is disposed substantially behind said plane;

a drive shaft operatively connected to said high-pressure fuel pump;

wherein said drive shaft is driven by the accessory drive system;

a camshaft configured to operate said high-pressure fuel pump; and wherein said drive shaft is configured to selectively telescope within said camshaft in the presence of an axial force of sufficient magnitude.

10. The high-pressure fuel pump assembly of claim 9, wherein said drive shaft includes a plurality of pleats and wherein said drive shaft is configured to selectively buckle in the presence of an axial force of sufficient magnitude.

11. The high-pressure fuel pump assembly of claim 9, wherein the accessory drive system is driven by a drive belt.

* * * * *